United States Patent [19]

Gaysert et al.

[11] Patent Number: 4,732,322

[45] Date of Patent: Mar. 22, 1988

[54] LIQUID FUEL ULTRASONIC ATOMIZER CONSTRUCTION FOR A HEATER

[75] Inventors: Gerhard Gaysert, Esslingen; Jakob Hilber, Leonberg; Dieter Götz, Kirchheim/Teck, all of Fed. Rep. of Germany

[73] Assignee: J. Eberspächer, Fed. Rep. of Germany

[21] Appl. No.: 877,290

[22] Filed: Jun. 23, 1986

[30] Foreign Application Priority Data

Jun. 25, 1985 [DE] Fed. Rep. of Germany ..... 3522697

[51] Int. Cl.[4] ..... B05B 3/14

[52] U.S. Cl. ..... 239/102.2; 239/600; 310/325

[58] Field of Search ..... 239/102.1, 102.2, 600; 310/323, 325; 431/154, 343; 248/27.3

[56] References Cited

U.S. PATENT DOCUMENTS 2,723,160 11/1955 Stavardt ..... 239/424 X
3,012,400 12/1961 Corson et al. ..... 239/424 X
3,796,536 3/1974 Hori et al. ..... 239/102.2 X
4,251,031 2/1981 Martin et al. ..... 239/102.2
4,294,215 10/1981 Han et al. ..... 239/600 X

FOREIGN PATENT DOCUMENTS 57466 8/1982 European Pat. Off. ..... 239/102.2
3343617 6/1985 Fed. Rep. of Germany .

*Primary Examiner*—Andres Kashnikow
*Assistant Examiner*—Kevin P. Weldon
*Attorney, Agent, or Firm*—McGlew and Tuttle

[57] ABSTRACT

An arrangement for the retention of an ultrasonic atomizer has the advantage of little influence on the vibration system due to the fuel supply connections and reduced bearing surface of the ultrasonic atomizer. The construction permits quick installation through since the retention is effected with a clamp. The fuel supply occurs via a bore opening into an annular channel in the structural part in which the ultrasonic atomizer is mounted. The atomizer is retained by a small bearing surface. A radial bore in a lug of the ultrasonic atomizer is a component part of the horn of the atomizer.

5 Claims, 3 Drawing Figures

LIQUID FUEL ULTRASONIC ATOMIZER CONSTRUCTION FOR A HEATER

BACKGROUND OF THE INVENTION

FIELD OF THE INVENTION

This invention relates in general to the construction of heaters and in particular to a new liquid fuel heater having an ultrasonic atomizer.

The invention relates to the arrangement of an ultrasonic atomizer in a heater operated with liquid fuel and comprising a combustion chamber with a heat exchanger contiguous thereto and an ignition zone into which the igniting means extends, also having a burner head with means for supplying fuel and combustion air, and where the ultrasonic atomizer includes a piezoelectric part with associated current feed between a front and a rear metallic part, the front metallic part comprising a hornshaped emitter with an attached atomizer disk. The hornshaped emitter comprising a central longitudinal bore and the front metallic part includes a radial bore associated with this longitudinal fore, for fuel supply.

The use of an ultrasonic atomizer for burners for atomizing the liquid fuel is known in stationary heating systems, but for vehicles its use in heaters is not customary. Only DE-OS No. 33 43 617 describes an ultrasonic atomizer arrangement for small heaters and shows the layout in particular of the ignition zone of such an arrangement.

SUMMARY OF THE INVENTION

The invention proceeds from a state of the art as disclosed in DE-OS No. 27 43 863. This disclosure illustrates and describes a number of solutions for the mounting of an ultrasonic atomizer in a stationary burner installation. These, however, all have the disadvantage that the holding elements cause a relatively great mechanical damping of the ultrasonic vibrations, and further that the vibrations of the ultrasonic oscillator apply stress on the fuel supply. The fuel supply itself—as in the arrangement according to DE-OS No. 33 43 617 also—contributes to a damping of the vibratory system, so that advantages achieved by the design of the mount are in part cancelled out. In these known arrangements the vibration and the physical relationships between the fuel supply and the mount of the ultrasonic oscillator atomizer were not taken into account. Another disadvantage of the known arrangement is the greater cost of assembly, in particular due to necessary screw connections, which moreover must be specially secured in the swinging system.

The present invention provides an arrangement in which an ultrasonic atomizer is mounted and retained in such a way, and the fuel supply to the ultrasonic atomizer occurs so that, the effect on the oscillatory system is minimized. The construction can be used in small burner units, in particular for vehicular heaters; in addition, the ultrasonic atomizer is to be easy to install.

This ultrasonic atomizer is arranged inside the burner head in the longitudinal axis thereof in a seating body provided with a stepped longitudinal passage bore. The seating body has in the region of the lug of the stepped bore, an annular groove and a radial bore opening into this annular groove. The annular groove constitutes a connection to the radial bore of the front (downstream) metallic part and further the ultrasonic atomizer is pressed resiliently by a pivotable clasp engaging at its rear (upstream) part against an abutment surface inside the stepped bore. By this new arrangement it is achieved that the fuel supply tube is separated from the ultrasonic atomizer and thus is isolated in terms of vibration, and due to the resilient suspension, little damping occurs. In addition, this arrangement is easy to install and manages without separate small parts, such as screws.

To bring the clamping point as close as possible to the oscillating piezoelectric elements, to cause a minimum of damping of the vibrations, it is provided that the front metallic part of the ultrasonic atomizer has a height of $(D+2a)$, where D is the diameter of the radial bore and a is the wall thickness of the radial bore measured to the abutment surface, and this wall thickness can, if necessary, be made very small, i.e. about 0.5 to 1 mm. It is thereby achieved that the abutment surface is very close to the vibration node of the ultrasonic atomizer. To obtain reliable fuel supply, it has proven advantageous to make the axial length of the annular groove in the seating body $(1.0 \text{ to } 1.5)\times(D/2+a)$.

A contributing factor to the reduction of the installed height of the ultrasonic atomizer is also that the annular groove is arranged in the stepped bore in the region of the larger diameter. Thereby an arrangement is obtained in which the ultrasonic atomizer is seated by its front, downstream part on the shoulder formed by the transition from the larger to the smaller diameter of the longitudinal passage bore in the seating body, which shoulder can be made extremely narrow, and in which reliable fuel supply is ensured. To reduce the abutment surface of the ultrasonic atomizer in the longitudinal passage bore of the seating body, according to a development of the invention, an abutment surface is arranged between the ultrasonic atomizer and the shoulder of the stepped bore. The abutment surface may consist of a simple ring or of a contoured ring which in cross-section has an upwardly directed tip, so that the ultrasonic atomizer makes contact on a line only.

For the fuel supply it has proved appropriate that a fuel supply line is introduced into the radial bore of the seating body. The line can thus be made flexible and can be introduced into the radial bore of the seating body far enough.

This arrangement has the advantage that at the time of installation, or of a later disassembly, the fuel line can be introduced or removed easily without a need for a special tool. The electrical connections to the piezoelectric part are made via a line which is passed through the burner head appropriately over a spout type elastic element.

In the arrangements, the combustion air is supplied upstream, that is, before the ultrasonic atomizer, and is supplied to the ignition zone flowing around the atomizer. To obtain an especially large flow cross-section, a development of the invention provides that the seating body is connected with the burner head through at least one web, the web having the radial bore. The webs may be formed in the burner head by casting and may have the form of guide surfaces for the combustion air stream.

Essential to the invention is also the retention of the ultrasonic atomizer by means of the pivotably mounted resilient clasp. A development of the invention is characterized in that the clasp carries prolongations, bent mainly in a downstream direction, with end-side loops, by which it is pivotably mounted through a pin for each applied on the inner wall of the burner head. The pin may be integrally formed on the inner surface of the burner head. By this advantageous design reliable centering and simultaneous retention of the ultrasonic atomizer is obtained. Advantageous also is the fact that the pivotably mounted clasp is not loosely placed in and therefore cannot get lost when the atomizer is removed, as can happen for example with mounts by means of inserted springs. To achieve punctiform contact and hence very slight mechanical damping of the ultrasonic atomizer, the clasp, made preferably of spring steel wire, has a central projection directed downstream. Lastly an appropriate realization is characterized in that the rear end face of the ultrasonic atomizer has an embossment for the fixation of the central projection of the clasp.

Accordingly it is an object of the invention to provide an improved heater which includes a housing for a combustion chamber having an ignition means thereof with a central seating body portion having a longitudinal bore to which is fitted a liquid fuel atomizer, the fuel being supplied to the atomizer through a bore defined in a web portion of the seating body and delivery into an annular groove of this seating body defined in the bore thereof and with improved resilient means for securing the atomizer against a face of the seating body.

A further object of the invention is to provide a liquid fuel atomizer mounting arrangement particularly for heaters which is simple and designed rugged in construction and economical to manufacture.

The standard clause is more than one embodiment.

GENERAL DESCRIPTION OF THE PREFERRED EMBODIMENTS

Figure 1:
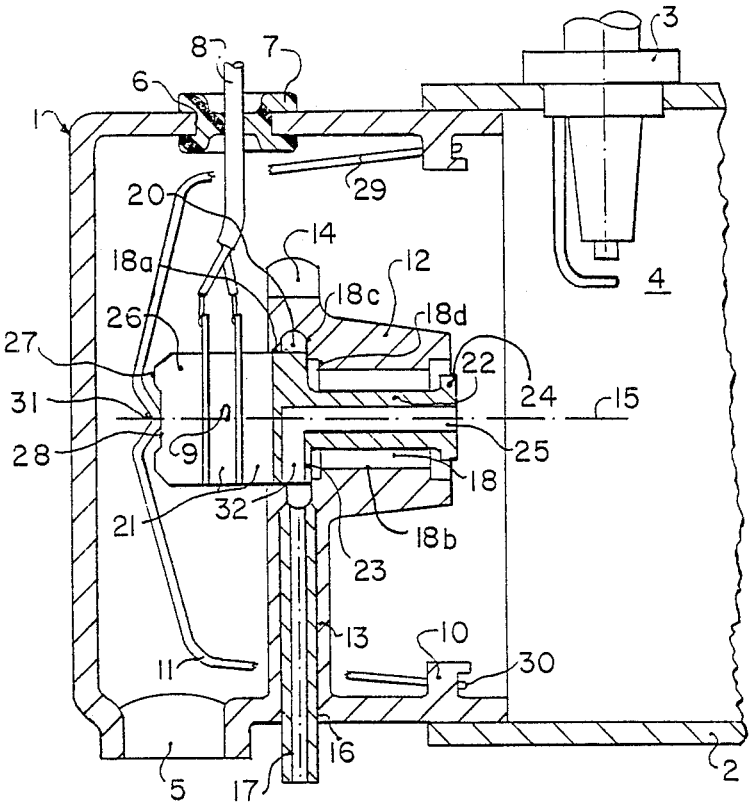
FIG. 1 is an aerial sectional view of the burner head constructed in accordance with the invention.

Referring to the drawings in particular the invention provides liquid fueled heater having a burner head 1 range adjacent and housing portion 2 defining a combustion chamber which has a heat exchanger contiguous thereto and has an ignition zone or in which liquid fuel is ignited by ignition means such as a spark plug 3.

FIG. 1 shows the burner head 1, which is detachably connected with the housing 2 of the heater. Housing 2 carries the spark plug 3 for ignition of the ignitable mixture in the ignition zone 4 of the heater. Integrally formed on the burner head 1 is a pipe 5 for combustion air supply. A bore 6 carries a spout type elastic insert 7 with a bore for lead-through of the electric connections 8 of the ultrasonic atomizer 9. Further there are integrally formed on the burner head 1 inwardly protruding lugs 10, which serve to retain the pivotably arranged clasp 11 made of spring steel wire. This clasp 11 made preferably of spring steel wire has an inherent mass which is small as compared with the acoustically active equivalent mass of the ultrasonic atomizer 9 itself, thereby contributing to insignificant damping of the atomizer oscillation.

In the longitudianl axis 15 of the burner head 1 is the seating body 12, in which the ultrasonic atomizer 9 is mounted. This seating body, or disk member 12 is connected with the burner head 1 preferably via two or three webs 13, 14. The body 12 may also be a disk provided with air passage bores, in which case the clasp 11 is pivotably arranged at a corresponding element of the disk. By the arrangement of the webs 13 and 14 an especially good combustion air supply is obtained. It is then possible to design the webs 13 and 14 as air guiding elements, e.g. in vane form. The webs 13 and 14 may be integrally formed with the burner head 1. One of the webs, in the embodiment shown, web 13, has a bore 16. It serves to supply the fuel to the ultrasonic atomizer 9. In the embodiment a fuel line 17 is disposed in the bore 16, but of course web may be formed as a full line.

The seating body 12 has a longitudinal passage bore 18. The latter is formed as a stepped bore with at least one section 18*a* of larger diameter and one section 18*b* of smaller diameter. The shoulder (abutment surface) 18*c* formed between the two sections serves as bearing surface for the ultrasonic atomizer 9. In the embodiment according to FIG. 1 an additional offset 18*d* is formed on, so that the seating surface for the ultrasonic atomizer 9 is as small as possible.

Figure 3:
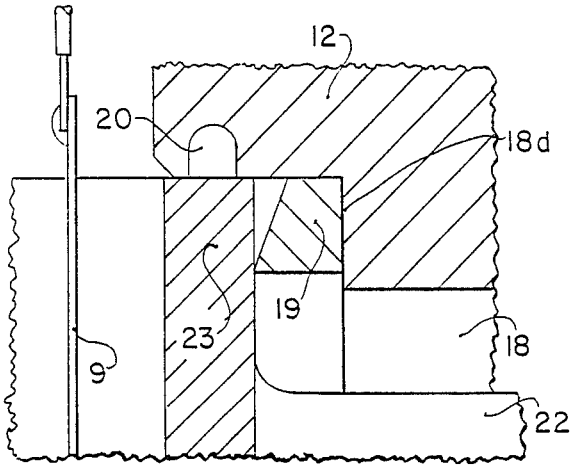
FIG. 3, is a view similar to FIG. 2 of a variant of the suspension of the ultrasonic atomizer.

FIG. 3 shows a variant seating body 12, with a bore 18 offset once and with a seating ring 19 placed on shoulder 18*d*. This ring is designed in an especiallly advantageous manner so that the bearing surface for the ultrasonic atomizer 9 comprises only a circle line and thus is minimized.

Thereby the mechanical damping of the atomizer vibrations is reduced to a minimum. In the section 18*a* of larger diameter an annular groove 20 is arranged. It cooperates with the fuel supply feed bore 16, i.e. the fuel supplied via line 17 gets into the annular groove 20 and thence into the ultrasonic atomizer 9 and the seating part 12.

Figure 2:
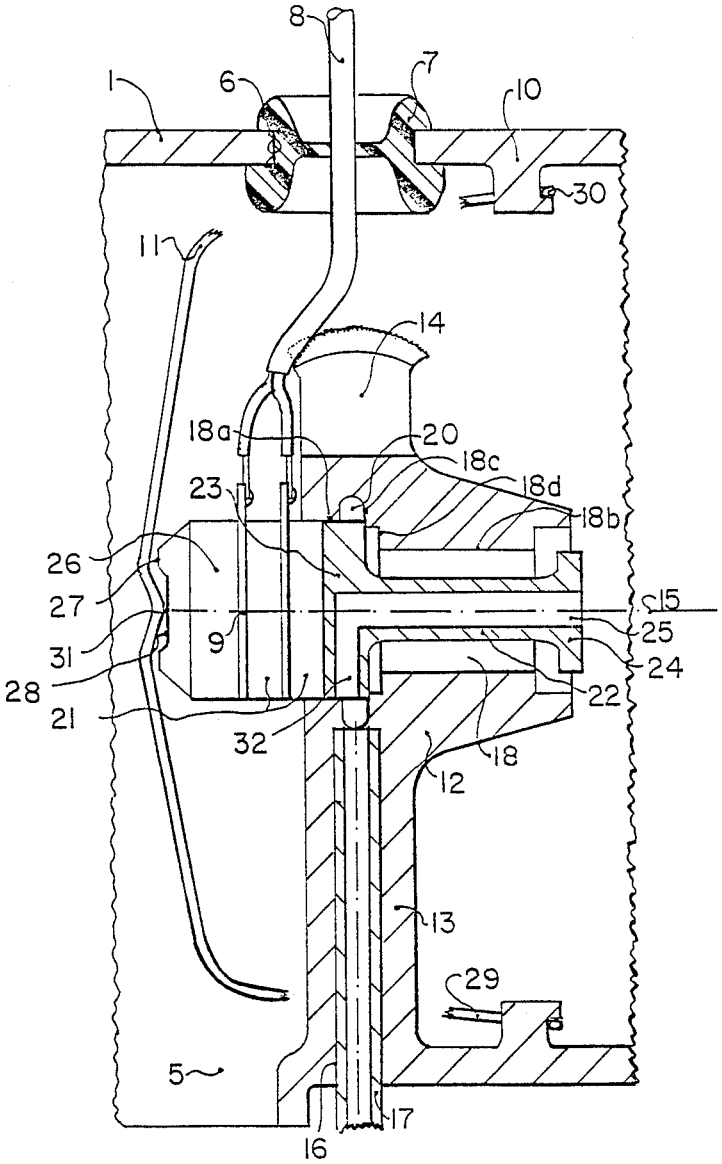
FIG. 2 is a detailed sectional view of the suspension and retention of the ultrasonic atomizer.

The ultrasonic atomizer 9 is designed in known manner and comprises as shown in FIG. 2 a piezoelectric transducer element 21 which is composed of two ring-shaped disks, with the respective electric connections 8, and which is coupled with an amplitude transformer or horn 22 mechanically fixed. In the transducer element 21 occurs the transformation of electrical to mechanical energy, while in horn 22 an increase in amplitude is achieved. Horn 22 is integrally formed on a metallic part or rear bearing surface 23 and has an atomizer disk 24 at is downstream end. The metallic part 23 (upstream portion of horn 22) is provided with a radial bore 32 which extends to the longitudinal axis of the ultrasonic atomizer 9 and there opens into a longitudinal bore 25 of horn 22. The radial bore 32 is in passage connection with the annular groove 20, so that the fuel can be supplied to the ignition zone 4 via line 17, annular groove 20, radial bore 32 and longitudinal bore 25. Upstream of the piezoelectric transducer element 21 a rear metallic part 26 is arranged, which also serves as a nut of the screw connection of the ultrasonic atomizer 9. This part 26 has an upstream end with a flat end face 27, which may have a central depression 28 for the fixation of the clasp 11, so that punctiform contact exists between clasp 11 and face 27. This results in a strong acoustic mismatch between ultrasonic atomizer 9 and clasp 11, which also leads to a low degree of damping of the atomizer vibration.

Clasp 11 comprises spring steel wire and carries extensions 29 bent in downstream direction, with end-side loops 30 for pivotable suspension in the lugs 10 of the burner head 1. The clasp 11 further comprises a central projection 31 directed downstream, which engages in the central depression 28 of the end faces 27 of the atomizer 9, thus pressing the ultrasonic atomizer 9 against the bearing surface 18*c* and so holding it.

With this arrangement according to the invention in a very simple, safe and quickly installable construction is provided, which has especially good atomization properties and is suitable for vehicular heaters in an advantageous manner.

What is claimed is:

1. In a liquid fueled heater including a housing defining a combustion chamber with a heat exchanger contiguous thereto and with an ignition zone in the combustion chamber having igniting means extending therein, the improvement comprising a burner head having radially extending web portions supported peripherally in the housing and having a central seating body portion with a longitudinally extending bore therethrough and havng a rear bearing surface, and including an annular grove defined in the longitudinally extending bore, a fuel conduit defined in the said web portion communicating with said annular groove, an ultrasonic atomizer having a peizoelectric part with a metallic portion forming a horn-shaped emitter having an atomizer disk with a central longitudinally extending emitter bore, said front metallic portion having a face bearing against said seating body rear bearing surface and having a radial bore providing communication between said fuel conduit and the emitter bore, said ultrasonic atomizer being disposed in said seating body bore, and a resilient clasp having a central part bearing against the rear of said ultrasonic atomizer and urgin said ultrasonic atomizer into bearing engagement with said seating body portion, said resilient clasp includes radially and axially extending portions, said burner head having lug portions defined in the interior thereof with which the axially extending portions of said clasp are engaged.

2. In a liquid fueled heater according to claim 1 wherein said annular groove is arranged in a stepped bore in the region of the portion of said longitudinally extending bore which has the largest diameter.

3. In a liquid fueled heater according to claim 1 wherein said seating body portion has a stepped bore including a ring disposed in said stepped bore forming a shoulder between said stepped portions of said bore.

4. In a liquid fueled heater according to claim 1 wherein one of said web portions of said burner head defines a radial bore fuel line.

5. Arrangement according to claim 1 wherein said ultrasonic atomizer has a rear end with a recess, said clasp having a projection projecting into said recess.

* * * * *